United States Patent [19]

Stack

[11] Patent Number: 4,997,044

[45] Date of Patent: Mar. 5, 1991

[54] APPARATUS FOR GENERATING HYDRAULIC SHOCK WAVES IN A WELL

[76] Inventor: Walter E. Stack, 812 W. Ellaine St., Pasadena, Tex. 77506

[21] Appl. No.: 444,300

[22] Filed: Dec. 1, 1989

[51] Int. Cl.[5] ..... E21B 43/25

[52] U.S. Cl. ..... 166/385; 166/65.1; 166/63; 166/249; 166/177

[58] Field of Search ..... 166/65.1, 249, 177, 166/248, 299, 311, 385; 175/4.51, 16

[56] References Cited

U.S. PATENT DOCUMENTS

| | | | |
|---|---|---|---|
| 1,457,479 | 6/1923 | Wolcott | 166/60 X |
| 3,180,418 | 4/1965 | MacLeod | 166/65.1 X |
| 4,074,758 | 2/1978 | Scott | 166/249 |
| 4,169,503 | 10/1979 | Scott | 166/65.1 |
| 4,343,356 | 8/1982 | Riggs et al. | 166/60 |
| 4,345,650 | 8/1982 | Wesley | 166/249 |
| 4,479,680 | 10/1984 | Wesley et al. | 166/249 |

*Primary Examiner*—Stephen J. Novosad
*Attorney, Agent, or Firm*—Dodge Bush & Moseley

[57] ABSTRACT

Apparatus for electrically generating hydraulic shock waves in a fluid bearing formation (14) of a bore hole (10) including a tool (16) having an upper electrode (42) and a lower electrode (46) forming a spark gap therebetween. The tool (16) has an upper end portion (40) comprised of a plurality of sections (40A–40E) threaded to each other in end to end relation and an armored electrical cable (18) having an outer metal sheath (34) is anchored to the uppermost section (40A). The tool (16) is particularly adapted for fitting within a casing having a four inch diameter and the electrodes (42,46) have diverging planar end surface portions (84) coated with tungsten carbide to provide wear resistant surfaces.

19 Claims, 3 Drawing Sheets

APPARATUS FOR GENERATING HYDRAULIC SHOCK WAVES IN A WELL

BACKGROUND OF THE INVENTION

This invention relates to an apparatus for generating hydraulic shock waves in an oil, gas, or water bearing formation, and more particularly to such apparatus including a tool that may be lowered within a well from an electrical cable and provide an electrically generated shock wave for the recovery of fluids, such as crude oil, gas or water.

Heretofore, various processes and apparatus have been provided for the recovery of crude oil by means of sonic wave generations. The generation of a sonic wave front at or near an oil bearing formation provides sonic energy projecting a substantial distance into the formation for stimulating the recovery of oil from the formation particularly at adjacent wells. Sonic waves may be produced from shock waves resulting from the release of electrical energy adjacent the oil bearing formation and it is desirable to release substantial electrical energy in order to generate the intensity of shock or pressure waves required for a substantial recovery of oil or gas. Some of the disadvantages associated with the use of sonic and ultrasonic energy at both high and low frequency ranges are (1) high frequency waves attenuate too quickly in the formation and (2) low frequency waves at high amplitudes release debris which tends to restrict flow around the wellbore.

Electrical energy has been previously employed for the generation of shock waves for the recovery of oil. For example, U.S. Pat. No. 4,074,758 dated Feb. 21, 1978 shows a method and apparatus utilizing an electrical energy storage capacitor bank to provide electrical energy to a shock wave generator adjacent an oil bearing formation and having a pair of discharge electrodes forming a spark gap therebetween. An electrohydraulic shock wave is generated by liquid in the well from a shock wave generator lowered within the casing to a desired depth.

U.S. Pat. No. 4,345,650 dated Aug. 24, 1982 also shows a method and apparatus utilizing electrical energy to provide a shock wave at the oil bearing formation. However, the '650 patent utilizes a tool having an electrical energy storage capacitor bank therein adjacent the electrodes in the borehole to provide sufficient electrical energy. A relatively complex downhole tool is required, however, in order to house the storage capacitor bank and associated equipment shown in this patent for generating the explosive spark across the electrodes.

As well known, when electrical energy of a high voltage, such as 75000 volts or higher, is required downhole, power surges occur in the system from electrical energy flowing both down into the borehole and up from the borehole. Such power surges oftentimes result in overloading of the system and actuation of overload safety devices. The '650 patent minimizes this problem by locating the storage capacitor bank downhole.

SUMMARY OF PRESENT INVENTION

The present invention is directed to an apparatus including a tool containing two electrodes and particularly designed for utilizing electrical energy from a storage capacitor bank at a surface location. The tool is designed for the flow of electrical energy to the electrodes as high as 70,000 volts for example, and has been found to function effectively with minimal power surges occurring in the associated system. Additionally, the tool is designed to have a diameter of around three and one-half ($3\frac{1}{2}$) inches for easily fitting within a four (4) inch casing which is a common size of casing employed for wells.

The tool is lowered within a borehole to a desired depth beneath a liquid fluid, such as crude oil, for firing an explosive charge of electrical energy into an adjacent oil bearing formation upon the generation of spark across the gap between the electrodes. The storage capacitor bank is located at a surface location and an electrical cable supporting the tool extends between the tool and capacitor bank for transmitting the electrical energy to the tool.

The firing of the charge of electrical energy between the electrodes results in energy advancing from the electrodes is two forms, a shock wave and a hydraulic wave. The shock wave is transmitted through the formation at a relatively rapid rate and tends to separate crude oil from the formation. The hydraulic wave follows the shock wave with the advancing front of the hydraulic wave defining a sphere and tending to push outwardly any separated liquid, such as crude oil. Controls at the surface location are set for a desired voltage, amplitude, and frequency depending on such factors as the type of formation and viscosity of the liquid being removed.

The present system and tool may also be employed for such purposes such as fracturing a formation, opening of plugged perforations in a screen or the like, and cleaning of downhole screens without removal from the borehole.

The generally cylindrical tool body includes an upper body portion for housing the positive electrode and a lower body portion for housing the negative electrode. The upper body portion includes a plurality of sections threaded to each other in end to end relation. The electrodes are arranged in end-to-end relation and define a gap therebetween adjacent one side of the electrodes. The end surfaces of the electrodes adjacent the spark gap diverge outwardly from each other and are formed of a tungsten carbide surface for minimizing wear and corrosion resulting from the firing of the electrical charge.

The upper body portion comprises four separate sections threaded to each other in end to end relation including (1) an upper anchor section for anchoring an armored electrical cable, (2) a ground section containing a plurality of ground wires arranged in an annular pattern, (3) an upper connector section for anchoring the ground wires and transmitting the negative electrical field, (4) and a lower connector section for a hand wrapped stress relief connection. A preassembled cage assembly for the two electrodes in formed from a positive electrode section and a negative electrode section which are connected to each other by a pair of spaced bars and provide mounting for the two electrodes. The cage assembly has female end connections which are easily connected to adjacent sections.

A large diameter armored electrical cable capable of supporting a tensile load of 90,000 pounds extends between the storage capacitor bank at a surface location and the tool. The cable has an outer metal sheath secured to the anchor section of the upper body portion for anchoring the cable. A plurality of ground leads from the electrical cable are spaced about the cable in the ground section and have their ends connected to a steel ring for transmitting the negative electrical field to the lower electrode.

It is an object of the present invention to provide an apparatus for generating electrical shock waves including a downhole tool having a pair of electrodes for firing an explosive charge of electrical energy into an adjacent fluid bearing formation from electrical energy supplied from a storage capacitor bank at a surface location thereby to provide a hydraulic shock wave.

It is a further object of the invention to provide such a tool having a pair of electrodes arranged end to end to define the spark gap on one side of the electrodes with adjacent end surfaces diverging from the spark gap and formed of a wear and corrosion resistant surface.

A further object of this invention is to provide a small diameter electrical tool for fitting within a four inch casing and assembled from a plurality of sections threaded to each other in end to end relation and including a preassembled cage assembly for the electrodes.

Other objects, features, and advantages of this invention will become more apparent after referring to the following specification and drawings.

DESCRIPTION OF THE INVENTION

Figures 1, 3:
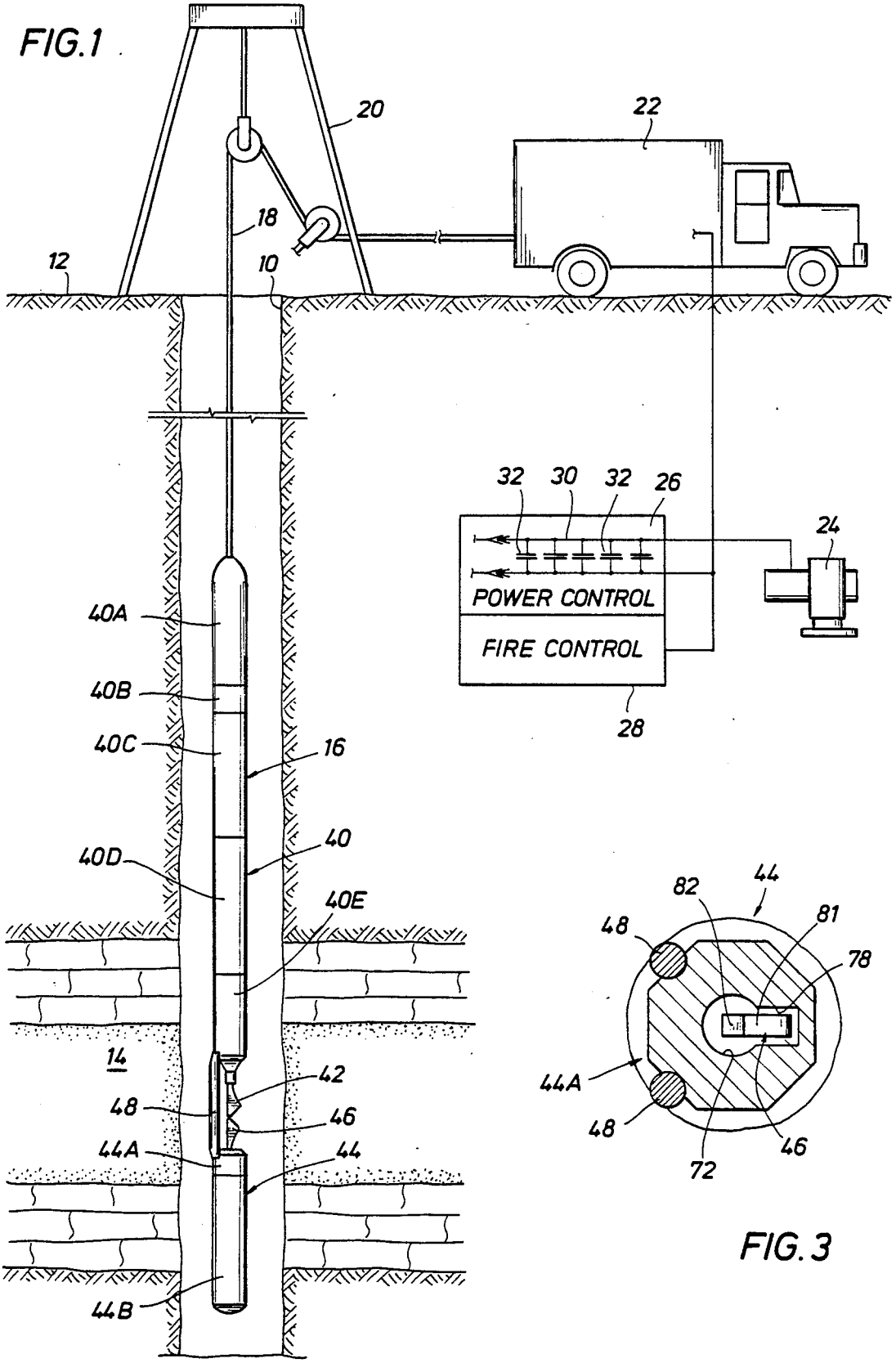
FIG. 1 is a schematic view showing the apparatus of the present invention including the downhole tool and associated surface apparatus for lowering the tool and generating electrical energy for providing electrical energy to the electrodes of the tool.
FIG. 3 is an enlarged view taken generally along line 3—3 of FIG. 2B and showing in plan an end of an electrode.

Referring now to the drawings for a better understanding of this invention and more particularly to FIG. 1, a borehole is shown generally at 10 extending from the surface 12 of an earth formation having an oil bearing stratum or layer at 14. A tool generally indicated at 16 and forming an important part of this invention is shown downhole adapted to provide a hydraulic shock wave from the discharge of explosive electrical energy through the fluid bearing layer 14 of a producing zone, such as oil or gas.

An armored electrical cable 18 supported from a derrick 20 is connected to tool 16 and controlled from a storage reel 21 in a logging truck 22. Truck 22 includes a source of electrical energy provided by generator 24 connected to power control circuitry 26 and fire control circuitry 28 for tool 16. A suitable control panel is provided so that an operator in truck 22 may control the operation of tool 16. Power control circuit 26 includes a capacitor bank 30 having a predetermined number of large magnitude capacitors 32 electrically connected to cable 18 and tool 16. Thus, the release of electrical energy from tool 16 is controlled by an operator from truck 22 for the producing of shock waves and resulting hydraulic waves from the oil for migration of the oil away from bore 10.

Figure 2A:
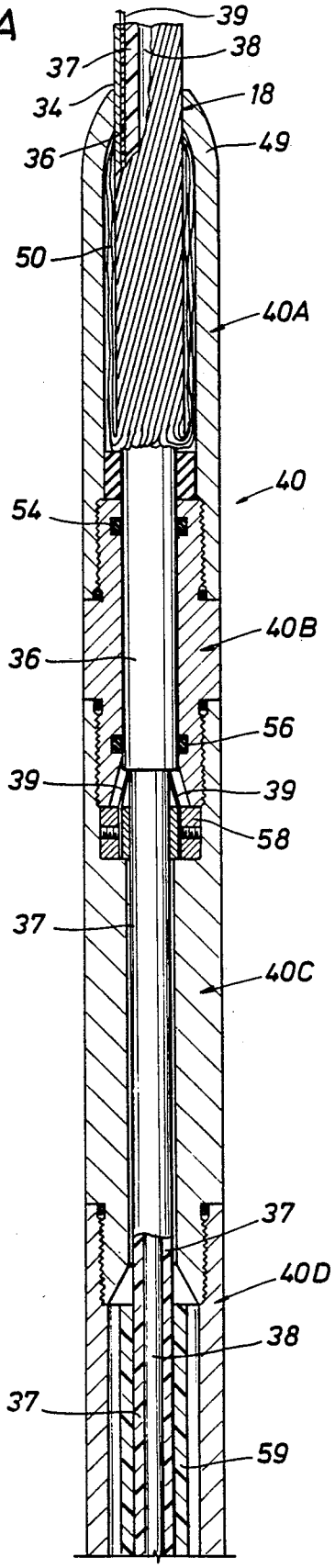
FIG. 2A is a longitudinal sectional view of the upper portion of the tool showing the connection to the electrical cable.
Figure 2B:
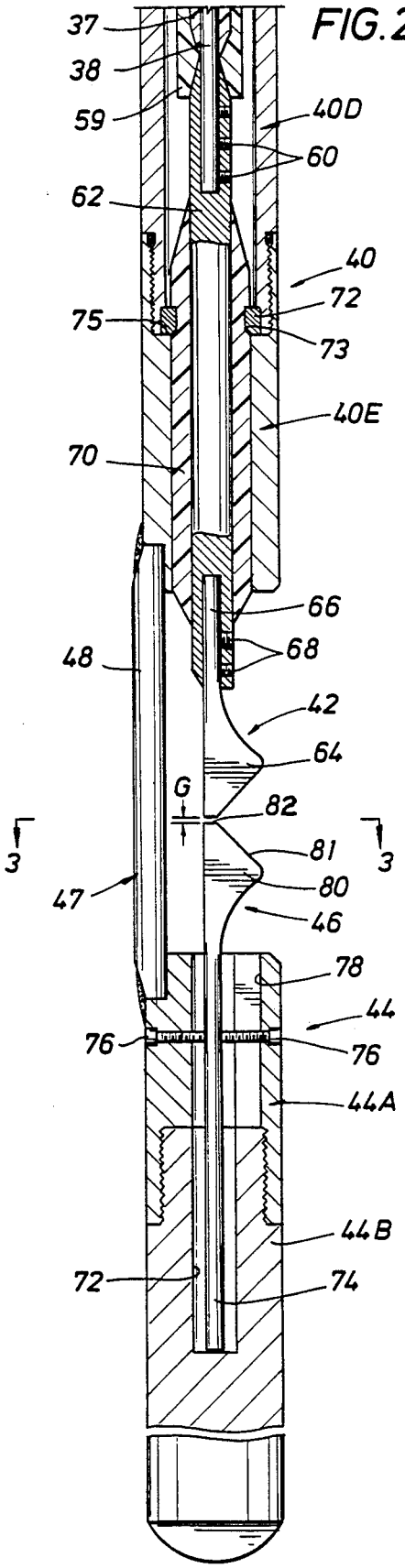
FIG. 2B is a longitudinal sectional view of the lower portion of the tool of FIG. 2A and showing the pair of electrodes forming a spark gap therebetween.

Referring now to FIGS. 2A, 2B and 3, tool 16 is shown connected at its upper end to an armored cable 18. An armored cable 18 includes an outer metal sheath 34 formed of counter wound metal layers, an adjacent outer insulating layer or lines 36 of a plastic insulating material encapsulating a plurality of spaced ground leads 39, an inner insulating layer 37 adjacent layer 36, and a central copper conductor core 38 surrounded by insulating layer 37. Tool 16 is of a generally cylindrical shape and has a maximum diameter less than around $3\frac{3}{4}$ inches for easily fitting within a casing of four (4) inches in diameter. Tool 16 includes an upper end body portion generally designated 40 for housing an upper positive electrode generally designated 42, and a lower end body portion generally designated 44 for housing a lower negative electrode generally designated 46. A pair of connecting ribs or bars 48 are secured between body portions 40 and 44 for connecting upper body portion 40 to lower body portion 44 and to transmit the negative electrical field to negative electrode 46. Electrodes 42 and 46 are of substantially the same shape. It is noted that a cage assembly 47 is preassembled from a pair of spaced electrode sections connected by the small diameter bars 48 to mount electrodes 42, 46 is a precise relation for generating a hydraulic shock wave of tool 16 about substantially the entire periphery as will be explained further.

Upper end portion 40 comprises an outer mandrel body having five threaded tubular sections 40A, 40B, 40C, 40D and 40E connected to each other in end-to-end threaded relation Section 40A forms an anchor section, section 40B forms a ground section, section 40C forms a connector section, section 40D forms a stress relief section, and section 40E forms a positive electrode section. The counter wound metal sheath 34 is stripped from the remainder of cable 18 and turned up to fill the void annular space 50 within uppermost anchor section 40A which has an upper tapered end 49. The turned up end portions of metal sheath 34 fits tightly within the annular space and bears against tapered end 49 for anchoring cable 18 thereat. Moisture proof seals or rings 54 formed of an elastomeric material are mounted about outer insulating lines 36 within ground section 40B for sealing thereabout. Ground leads 38 have their ends extending from encapsulating liner 36 and clamped by set screws between inner and outer conductor rings 57,58 mounted in the upper end of connector section 40C. If desired, a single conductor ring may be provided with spaced openings to receive the ends of leads 39 with set screws tightly clamping leads 39 within the ring.

Conductor 38 has its lower end secured by set screws 60 within a receiving socket in upper end portion 62 of upper electrode 42 prior to the connections of section 40D and subassembly 47, and prior to the connection of shank 66 of lower end portion 64 within a bore in upper end portion 62 of upper electrode 42 by set screws 68.

Inner insulating layer 37 in connector section 40C is formed of a semiconductor material such as black tape and extends to electrode 42. Electrode 42 includes an upper end portion 62 and a lower end portion 64. Insulation 37 from the lower end of section 40D to its lower end adjacent electrode 42 is hand wrapped with fiberglass tape 59 after the connection of conductor 38 to upper electrode portion 62. Next, an insulating sleeve 70 preferably formed of polytetrafluoroethylene is slipped about upper end portion 62. Then, connector section 40D is slipped over sleeve 70 and threaded onto section 40C. Next, a split shear ring 72 is mounted about an annular groove 73 of insulating sleeve 70 and engages a shoulder on section 40D. In this position, subassembly 47 comprising sections 40E and 44A connected by bars 48 is threaded onto section 40D with shoulder 75 of section 40E abutting shear ring 72. Thus, shear ring 72 accurately positions insulating sleeve 70 in addition to transferring shear loads from section 40E to section 40D through opposed shoulders on sections 40D, 40E. Additionally, ring 58 may act as a stabilizer between abutting sections 40B and 40C. Positive electrode 42 may now be mounted by fitting shank 66 of lower electrode portion 64 within the receiving bore of upper electrode portion 62 and securing set screws 68. It is noted that shank 66 should be bottomed in the bore to insure proper electrical transmission. While upper electrode 42 is shown formed of two portions primarily for ease of assembly, it is to be understood that upper electrode 42 could be formed of a single member if desired. Electrodes 42 and 46 are preferably formed of a silicon bronze material.

Lower end portion 44 of tool 16 which is connected to upper end portion 40 by rods 48 includes threaded sections 44A and 44B connected in end-to-end relation. Lower section 44B has a socket or end bore 72 receiving the end shank 74 of negative electrode 46. Set screws 76 in section 44A secure lower electrode 46 in position within lower end portion 44 and permit horizontal and longitudinal adjustment of electrode 46. A slot shown in broken lines at 78 is provided in section 44A to permit lower electrode 46 to be easily removed from end portion 44 without disassembly of sections 44A and 44B. A spark gap shown at G in FIG. 2B between the opposed ends of electrodes 42 and 46 is set for arcing at a predetermined voltage for firing of a charge or electrical energy to produce a shock wave in oil bearing layer 14. Gap G for example may be $\frac{1}{4}$ inch. The ends of sections 40E and 44A adjacent electrodes 42, 46 are of a hexagonal shape in plan as shown in FIG. 3 and include grooves for receiving and easily securing bars 48 while permitting the sections to easily fit within a four inch casing for which tool 16 is particularly designed. Normally, tool 16 would be utilized at a location within a liquid fluid to provide a hydraulic shock wave.

Figure 4:
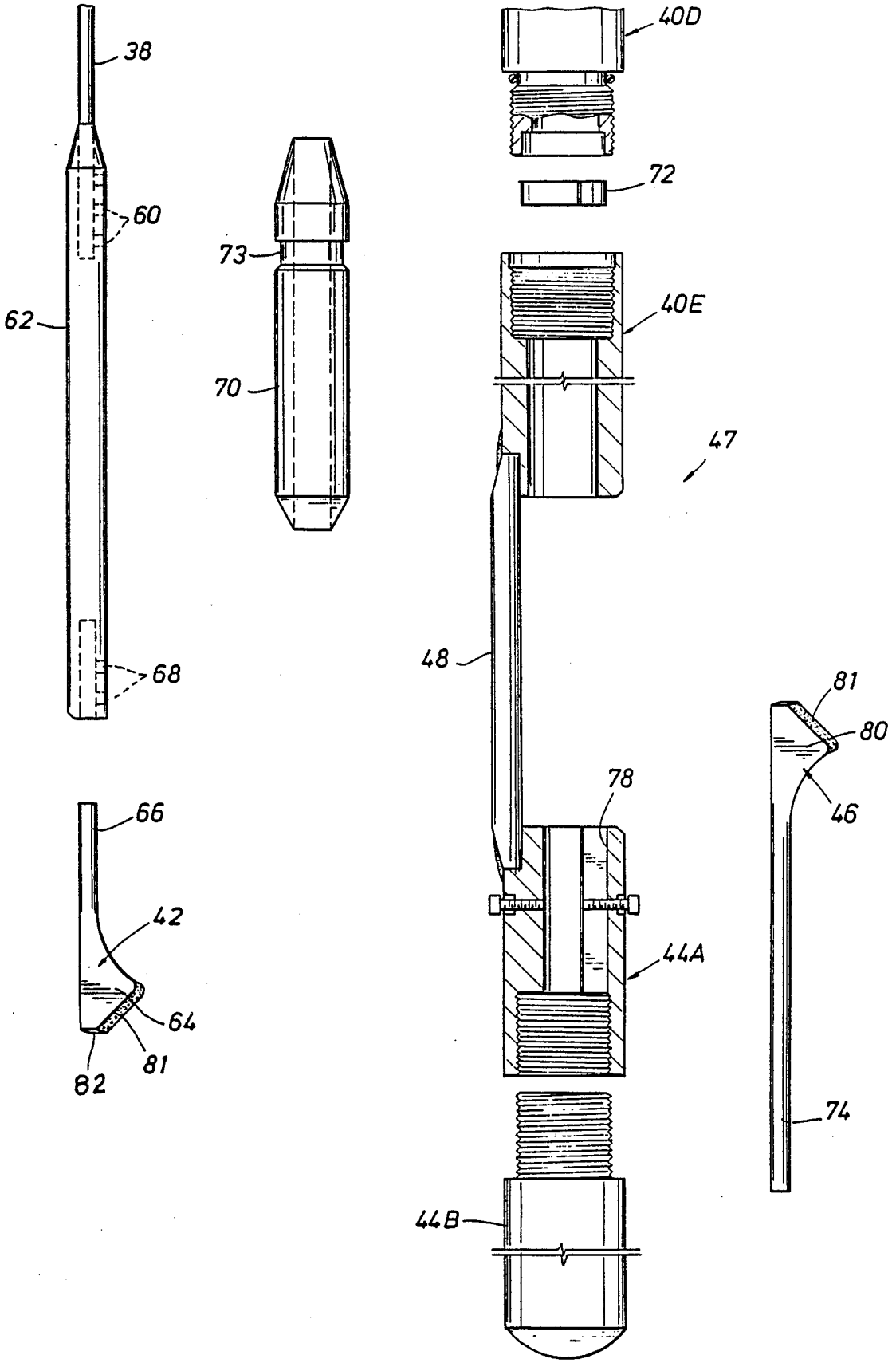
FIG. 4 is an exploded view of a portion of the tool for illustrating the assembly of the tool.

The enlarged end portions 64 and 80 of respective upper and lower electrodes 42,46 are generally identical. Referring to FIGS. 3 and 4, the shape of enlarged end portion 64 of electrode 42 is shown as comprising a generally flat or planar end surface 81 having a flat surface tip 82 at one side of the electrode and diverging from tip 82 at an angle of around 45° with respect to the longitudinal axis of tool 16 which is in alignment with the longitudinal axis of shank 66. Planar end surface 81 including surface tip 82 is of tungsten carbide to provide an abrasion resistant and corrosion resistant surface. End portion 64 has a thickness of around $\frac{5}{8}$ inch and diverging end surfaces 81 on electrodes 42,46 direct the shock wave to form a strong shock wave in the direction of end surfaces 81 although the shock wave is directed about substantially the entire perimeter of tool 16 except for the areas blocked by rods 48 which are $\frac{3}{4}$ inch in diameter.

An operator in truck 22 has suitable controls for determining the voltage amplitude and frequency for firing a charge of electrical energy across electrodes 42 and 46 into the oil bearing formation 14. The tool 16 of this invention provides a housing for electrical cable 18 and electrodes 42,46 which may be easily assembled from a minimal number of separate members. A relative large copper conductor 38 around $\frac{3}{8}$ inch in diameter is carried by cable 18 and is electrically connected to upper electrode 42. Ground leads 39 carried by cable 18 are electrically connected to lower negative electrode 42 through ground ring 58, sections 40C, 40D, 40E, and bars 48 to sections 44A and 44B.

For assembly, the separate body sections 40A–40D are connected to each other in sequence beginning with anchoring of section 40A to armored cable 18 by the stripping and turning up of outer metal sheath 34 within section 40A and the tight gripping of the turned up metal sheath by tapered end 49. Next, seal 52 is inserted about layer 36 within anchor section 40A and ground section 40B is threaded onto anchor section 40A with seals 54 and 56 about layer 36. The end of ground wires 39 extend outwardly from layer 36.

Next, the ends of ground wires 39 are clamped between rings 57, 58 by set screws 59 and connector section 40C is then threaded onto ground section 40B, with section 40C receiving rings 57,58. As indicated previously, ground wires 39 may be clamped within openings in a single ring if desired. Conductor 38 is then connected to upper electrode portion 62 by set screws 60. Next fiberglass tape 59 is hand wrapped about insulating sleeve 37 and an adjacent end portion of electrode 42. Insulating sleeve 70 is fitted about electrode portion 62. Then, section 40D is threaded onto section 40C. Split ring 72 is then mounted and the previously assembled cage subassembly 47 is threaded onto section 40D. Next, electrode portion 64 is mounted by set screws 68 and lower end section 44B is threaded onto section 44A. Now, lower electrode 46 may be inserted and spark gap G determined by adjustment of set screws 76. It is to be understood that suitable O-ring seals not shown in some instances are provided as seals between all of the connected sections 40A–40E.

As a non-limiting example, tool 16 may be of a diameter of three and one-half ($3\frac{1}{2}$) inches and of a length of around eight (8) feet with upper tool portion 40 being around five (5) feet long and lower tool portion 44 being around three (3) feet long. Cable 18 and the control panel with associated circuiting 26, 28 are adapted to carry around 70,000 volts with cable 18 capable of supporting a load of 90,000 pounds.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

I claim:

1. Apparatus for the discharge of electrical energy into a fluid bearing formation of a borehole to produce a hydraulic shock wave for assisting in the removal of fluid from the formation; said apparatus comprising:

a bank of capacitors positioned at a surface location for the storage of electrical energy;

a source of electrical energy to provide electrical energy to said bank of capacitors;

a tool positioned within said borehole adjacent the formation; and an electrical cable extending between said bank of capacitors and said tool for supplying electrical energy to said tool;

said tool having an upper end portion containing an upper electrode and a spaced lower end portion containing a lower electrode, said electrodes being in opposed spaced relation and defining a spark gap therebetween, said upper end portion of said tool having a plurality of tubular sections threadedly connected to each other in end to end relation;

said cable including a central electrical conductor and a ground conduit insulated from said central electrical conductor, said electrical ground conduct having ends secured to one of said tool sections of said upper end portion, the lowermost section of said tool sections having the electrode thereon connected to said conductor;

said electrical cable having an outer protective sheath secured to the uppermost of said sections of said upper end portion for anchoring said cable and supporting said tool.

2. Apparatus as set forth in claim 1 wherein a pair of connecting members are secured between said upper end portion and said lower end portion for connecting said end portions together.

3. Apparatus as set forth in claim 2 wherein said connecting members comprise a pair of bars secured to said end portions in such a manner to maintain a predetermined spark gap between said electrodes.

4. Apparatus for the discharge of electrical energy into a fluid bearing formation of a borehole to produce a hydraulic shock wave for assisting in the removal of fluid from the formation; sand apparatus comprising;

a bank of capacitors positioned at a surface location for the storage of electrical energy;

a source of electrical energy to provide electrical energy to said bank of capacitors;

a tool positioned within said borehole adjacent the formation; and an electrical cable extending between said bank of capacitors and said tool for supplying electrical energy to said tool;

said tool having an upper end portion containing an upper electrode and a spaced lower end portion containing a lower electrode, said electrodes being in opposed spaced relation and defining a spark gap therebetween, said upper end portion of said tool having a plurality of sections threadedly connected to each other in end to end relation;

said cable including a central electrical conductor and a ground conduit insulated from said central electrical conductor, said electrical ground conduct having ends secured to one of said tool sections of said upper end portion, the lowermost section of said tool sections having the electrode thereon connected to said conductor;

said upper and lower electrodes having opposed projecting tips spaced from each other to form the spark gap therebetween and having end surface portions diverging from said projecting tips in opposite directions, said tips and said adjacent end surface portions having an abrasion resistant material thereon for prolonging the life of said electrodes.

5. Apparatus as set forth in claim 4 wherein said abrasion resistant material is tungsten carbide.

6. Apparatus as set forth in claim 4 wherein said end surface portions of said electrodes are planar and of a generally uniform width.

7. Apparatus for the discharge of electrical energy into a fluid bearing formation of a borehole to produce a hydraulic shock wave for assisting in the removal of fluid from the formation; said apparatus comprising:

a bank of capacitors positioned at a surface location for the storage of electrical energy;

a source of electrical energy to provide electrical energy to said bank of capacitors;

a tool positioned within said borehole adjacent said fluid bearing formation and adapted to fit within a casing having a diameter of four inches;

an electrical cable extending between said bank of capacitors and said tool for supplying electrical energy to said tool;

said tool having an upper end portion containing an upper electrode and a spaced lower end portion containing a lower electrode, said electrodes being in opposed spaced relation and defining a spark gap therebetween; and rigid means connecting said lower portion to said upper portion to maintain a fixed spacing between said electrodes for said spark gap so that the shock waves emanating from the release of electrical energy by said electrodes is provided generally about the entire circumference of said tool;

said upper end portion of said tool including a plurality of tubular sections removably connected to each other in end to end relation, said electrical cable having an outer protecting sheath anchored to said upper end portion for supporting said tool.

8. Apparatus as set forth in claim 7 wherein said means connecting said lower portion of the tool to said upper portion thereof comprises a relatively small thickness bar secured between said upper and lower portions.

9. Apparatus as set forth in claim 7 wherein said cable has a central copper conductor electrically connected to said upper electrode and a ground lead electrically connected to said lower electrode.

10. Apparatus for the discharge of electrical energy into a fluid bearing formation of a borehole to produce a hydraulic shock wave for assisting in the removal of fluid from the formation; said apparatus comprising:

a bank of capacitors positioned at a surface location for the storage of electrical energy;

a source of electrical energy to provide electrical energy to said bank of capacitors;

a tool positioned within said borehole adjacent said fluid bearing formation and adapted to fit within a casing having a diameter of four inches;

an electrical cable extending between said bank of capacitors and said tool for supplying electrical energy to said tool;

said tool having an upper end portion containing an upper electrode and a spaced lower end portion containing a lower electrode, said electrodes being in opposed spaced relation and defining a spark gap therebetween; and means connecting said lower portion to said upper portion so that the shock waves emanating from the release of electrical energy by said electrodes is provided generally about the entire circumference of said tool;

said upper end portion of said tool including a plurality of sections threadedly connected to each other in end to end relation, said electrical cable having an outer metallic sheath and an adjacent inner liner containing a plurality of spaced ground leads, said metallic sheath being anchored to the uppermost section of said plurality of sections and said ground leads being connected to the section adjacent said uppermost section.

11. A tool adapted to be lowered within a borehole from an electrical cable for the discharge of electrical energy generated and stored at a surface location into a fluid bearing formation to provide a hydraulic shock wave; said tool comprising:

an upper end portion comprising a plurality of sections connected to each other in end-to-end threaded relation, the uppermost section of said plurality of sections having the electrical cable anchored thereto and the lowermost section of said plurality of sections having an upper positive electrode extending therefrom; and a lower end portion having a lower negative electrode extending therefrom in opposed spaced relation to said upper electrode; and means connecting said upper end portion to said lower end portion in spaced relation to each other for permitting an electrical shock wave about substantially the entire perimeter of the tool;

said upper and lower electrodes having projecting tips spaced from each other to form a predetermined spark gap therebetween and adjacent end surface portions diverging from said projecting tips for directing a portion of the electrical shock wave upon firing of the tool.

12. A tool as set forth in claim 11 wherein said tips and adjacent end surfaces have a tungsten carbide surface layer thereon to form an abrasion resistant surface.

13. A tool as set forth in claim 11 wherein the electrical cable connected to said tool has a central copper conductor and a plurality of ground leads insulated from the conductor, said conductor being electrically connected to said upper positive electrode and said ground leads being electrically connected to said lower negative electrode.

14. A tool as set forth in claim 13 wherein said electrical cable has an outer metallic sheath anchored to the uppermost of said plurality of sections.

15. A method of assembling a tool adapted to discharge within a borehole electrical energy supplied from a metal sheathed electrical cable supporting the tool, the electrical cable having a center electrical conductor and a ground lead spaced from the electrical conductor and insulated therefrom; said method comprising the following steps:

providing a plurality of sections adapted to be connected to each other in end-to-end threaded relation to form an upper end portion of the tool;

anchoring the outer metal sheath of the cable to one end section of said plurality of sections;

providing a seal between an unsheathed portion of the cable and the inner periphery of said one end section;

connecting the ground lead to a second section of said plurality of sections;

connecting said second section to said one end section in threaded end-to-end relation;

connecting the center electrical conductor to a positive electrode on an opposed end section; and connecting said opposed end section to said second section in threaded end-to-end relation.

16. The method as set forth in claim 15 including the further steps of:

providing a pair of sections adapted to be connected to each other in end-to-end threaded relation to form a lower end portion;

connecting said pair of sections to each other about a negative electrode extending from one of said pair of sections; and securing said upper end portion of said tool to said lower end portion with the electrodes in opposed spaced relation to each other to define a spark gap therebetween.

17. A method of assembling a tool adapted to fire a charge of electrical energy within a borehole while supported by an electrical cable containing a conductor supplying electrical energy to the tool from a bank of capacitors at a surface location; said method comprising the following steps:

providing an upper tool section for anchoring the cable to the tool;

providing a cage subassembly for mounting a pair of opposed electrodes and comprising of a pair of spaced mounted sections connected by a metal bar;

connecting an upper positive electrode to an extending end of an electrical conductor in said cable;

providing insulation over the positive electrode;

mounting the cage subassembly to said upper tool section over said insulation; and then mounting the lower negative electrode within said cage subassembly in spaced relation to said positive electrode to define a predetermined spark gap therebetween.

18. The method of assembling a tool as set forth in claim 17 further including the steps of:

providing an armored electrical cable having an outer metal sheath; and anchoring said metal sheath to said upper section of the tool.

19. The method of assembling a tool as set forth in claim 17 indicating the step of;

providing a separate insulating sleeve;

mounting the separate insulating sleeve about the upper positive electrode prior to the mounting of the cage assembly to said upper tool section.

* * * * *